US010941362B2

(12) United States Patent
Zhou

(10) Patent No.: US 10,941,362 B2
(45) Date of Patent: Mar. 9, 2021

(54) CLEAN, HIGH EFFICIENT AND ENVIRONMENTALLY FRIENDLY GASOLINE PRODUCT

(76) Inventor: Xiangjin Zhou, Beijing (CN)

( * ) Notice: Subject to any disclaimer, the term of this patent is extended or adjusted under 35 U.S.C. 154(b) by 111 days.

(21) Appl. No.: 13/806,482

(22) PCT Filed: Jun. 10, 2011

(86) PCT No.: PCT/CN2011/000969
§ 371 (c)(1),
(2), (4) Date: Jan. 28, 2013

(87) PCT Pub. No.: WO2011/160427
PCT Pub. Date: Dec. 29, 2011

(65) Prior Publication Data

US 2013/0125453 A1 May 23, 2013

(30) Foreign Application Priority Data

Jun. 21, 2010 (CN) ..... 201010214479.0

(51) Int. Cl.

| | |
|---|---|
| ***C10L 1/08*** | (2006.01) |
| ***C10L 1/06*** | (2006.01) |
| ***C10L 1/02*** | (2006.01) |
| ***C10L 1/14*** | (2006.01) |
| ***C10L 1/16*** | (2006.01) |
| ***C10L 1/182*** | (2006.01) |
| ***C10L 1/185*** | (2006.01) |

(52) U.S. Cl.
CPC ..... *C10L 1/08* (2013.01); *C10L 1/023* (2013.01); *C10L 1/06* (2013.01); *C10L 1/14* (2013.01); *C10L 1/1616* (2013.01); *C10L 1/182* (2013.01); *C10G 2300/305* (2013.01); *C10G 2400/02* (2013.01); *C10L 1/1824* (2013.01); *C10L 1/1852* (2013.01); *C10L 2200/043* (2013.01); *C10L 2200/0423* (2013.01); *C10L 2200/0446* (2013.01); *C10L 2230/22* (2013.01)

(58) Field of Classification Search
CPC ..... C10G 2300/305; C10G 2400/02; C10L 1/023; C10L 1/06; C10L 1/08; C10L 1/182; C10L 1/1824; C10L 1/1852; C10L 2200/0423; C10L 2200/043; C10L 2200/0446; C10L 2230/22; C10L 1/14; C10L 1/1616
USPC ..... 44/410, 447, 448, 451
See application file for complete search history.

(56) References Cited

U.S. PATENT DOCUMENTS

| | | | | | |
|---|---|---|---|---|---|
| 3,113,850 | A * | 12/1963 | Benning | ..... | 44/410 |
| 6,053,793 | A * | 4/2000 | Green | ..... | A01M 31/004 446/188 |
| 6,056,793 | A * | 5/2000 | Suppes | ..... | C10L 1/026 44/446 |
| 2002/0020107 | A1* | 2/2002 | Bailey et al. | ..... | 44/447 |
| 2003/0052041 | A1* | 3/2003 | Erwin | ..... | C10L 1/08 208/15 |
| 2004/0255510 | A1* | 12/2004 | Bongardt | ..... | C10L 1/191 44/388 |
| 2006/0180121 | A1* | 8/2006 | Wickman | ..... | F02D 19/0649 123/299 |
| 2008/0086933 | A1* | 4/2008 | Cunningham | ..... | C10L 1/023 44/451 |
| 2011/0088395 | A1* | 4/2011 | McNeil | ..... | C10L 1/026 60/616 |
| 2015/0107538 | A1 | 4/2015 | Sall et al. | | |

FOREIGN PATENT DOCUMENTS

| | | | | |
|---|---|---|---|---|
| AU | 2011269623 B2 | 9/2015 | | |
| CN | 1401743 A | 3/2003 | | |
| CN | 101343573 A | 1/2009 | | |
| CN | 102900555 A * | 1/2013 | | |
| CN | 102286299 B | 1/2016 | | |
| EP | 1443095 A1 * | 8/2004 | ..... | C10L 1/08 |

OTHER PUBLICATIONS

McAllister et al. Fundamentals of Combustion Processes. Springer. 2011. pp. 208-210.*

McAllister et al. Fundamentals of Combustion Processes. Springer. 2011. pp. 208-210 (Year: 2011).*

International Search Report (PCT/ISA/210) dated Sep. 22, 2011, by the Chinese Patent Office as the International Searching Authority for International Application No. PCT/CN2011/000969.

Written Opinion (PCT/ISA/237) dated Sep. 22, 2011, by the Chinese Patent Office as the International Searching Authority for International Application No. PCT/CN2011/000969.

Ciatti and Subramanian, An Experimental Investigation of Low Octane Gasoline in Diesel Engines, Sep. 29, 2010.

Przesmitzki, Gasoline Compression Ignition Technology, Enabling a Sustainable Mobility Solution, Sep. 18, 2015.

Saudi Aramco plays a strong role at Clean Fuels Symposium in Beijing, Jan. 18, 2018.

Saudi Aramco, Mazda Motor Corporation and AIST collaborate to develop the world's most advanced engine/ fuel combination, Aug. 8, 2018 (Dhahran, Saudi Arabia).

Yang et al., Combustion and emission characteristics of low octane number gasoline with partially diffused compression ignition, Automobile Safety and Energy Saving Journal, vol. 2, Issue 4, 330-337 (2011) (Abstract).

* cited by examiner

*Primary Examiner* — Latosha Hines
(74) *Attorney, Agent, or Firm* — Helen S Liu; Liu Law Office

(57) ABSTRACT

A clean, high efficient and environmentally friendly gasoline product with main fractions of C6-C11 has a low octane rating and a low spontaneous ignition temperature. It can be compressively ignited within an internal combustion engine with a compression ratio of 16-19. Small amount of ethanol or dimethyl ether can be added into the gasoline product.

11 Claims, No Drawings

CLEAN, HIGH EFFICIENT AND ENVIRONMENTALLY FRIENDLY GASOLINE PRODUCT

TECHNICAL FIELD

The present invention belongs to the field of oil refining and petrochemical engineering, and relates to a new kind of fuel oil (refined oil) product for internal combustion engine.

BACKGROUND

1. The Comparison of Diesel Engine with Gasoline Engine

Gasoline has a relatively higher spontaneous ignition temperature. A gasoline engine generally operates by means of spark ignition, and is usually called as spark-ignition engine. Diesel fuel has a relatively lower spontaneous ignition temperature. In a diesel engine, diesel fuel is generally injected into the engine cylinder directly through a fuel injection pump and a fuel nozzle, and mixed with compressed air therein. The mixture is spontaneously ignited under high temperature and high pressure, thus driving piston into work. A diesel engine is usually called as compression-ignition engine.

Generally, compared with a gasoline engine, a diesel engine has a 30% higher thermal efficiency, 45% lower greenhouse gases emissions, and low emissions of CO and hydrocarbon. Therefore, in order to save energy and reduce fuel cost, it is significant to promote the use of diesel engines.

A diesel engine has a higher thermal conversion efficiency than a gasoline engine, mainly because diesel engine has a larger compression ratio. Theoretically, larger the compression ratio, higher efficiency of the engine is. The compression ratio for a gasoline engine is generally 7-11, while that for a diesel engine is generally 14-22.

In recent years, a diesel engine has already adopted some advanced technologies, such as turbocharging, intercooler, direct injection, catalytic conversion of exhaust gas and particle collection, etc. The emissions of vehicles with diesel engine have met the Euro III, Euro IV and even Euro V emission standards.

The compression ratio of a diesel engine is restricted by the mechanical strength of engine materials, while that of a gasoline engine is restricted by the antiknock property of gasoline. With an excessive compression ratio, detonation phenomenon will appear during the combustion of air-fuel mixture.

Ordinary gasoline types in the market include unleaded gasoline 90#, 93#, 95#, 97# and 98#.

2. Table 1 Shows Octane Rating of a Part of Hydrocarbon Compounds Obtained from the Internet.

TABLE 1

| the relation between hydrocarbon structure and octane number | | | |
|---|---|---|---|
| n-heptane | $CH_3—(CH_2)_5—CH_3$ | octane number | 0 |
| n-octane | $CH_3—(CH_2)_6—CH_3$ | octane number | −17 |
| n-hexane | $CH_3—(CH_2)_4—CH_3$ | octane number | 25 |
| Octene-1 | $CH_2=CH—(CH_2)_5—CH_3$ | octane number | 34.7 |
| Pentane | $CH_3—(CH_2)_5—CH_3$ | octane number | 61 |
| Ethylcyclohexane | $CH_3—CH_2$-(cyclohexane) | octane number | 44 |
| Dimethylcyclohexane | $CH_3$-(cyclohexane)-$CH_3$ | octane number | 62 |
| Cyclohexane | | octane number | 77 |
| Hexene-4 | $CH_3—(CH_2)_2—CH=CH—(CH_2)_2—CH_3$ | octane number | 74.3 |
| Hexene-1 | $CH_2=CH—(CH_2)_3—CH_3$ | octane number | 80 |
| Isooctane | $(CH_3)_3C—CH_2—CH(CH_3)_2$ | octane number | 100 |
| Butene-1 | $CH_2=CH—CH_2CH_3$ | octane number | 106 |
| Ethylbenzene | 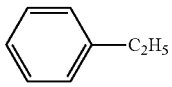 | octane number | 98 |
| Dimethylbenzene | $CH_3—(C_6H_4)—CH_3$ | octane number | 103 |
| Methylbenzene | 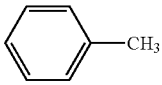 | octane number | 104 |
| Benzene | $C_6H_6$ | octane number | 108 |

3. Aromatic Hydrocarbons and Octane Rating

Regular gasoline contains xylene, ethylbenzene, toluene, methyl-ethyl benzene or other benzene derivatives, which are generally with a high octane rating and used as important chemical materials. After being extracted, the octane rating of gasoline will be sharply declined, and cannot meet the requirements on gasoline quality in the market. This causes the struggling for materials between chemical products and gasoline products.

Aromatic hydrocarbons generally have mildly virulent. The concept of fuel containing no aromatic hydrocarbons is suggested in the world recently.

4. Antiknock Additive

To improve the octane rating of gasoline, gasoline supplier sometime adds gasoline antiknock additive. Regular gasoline antiknock additives mainly include alkyl lead, methyl cyclopentadienyl manganese tricarbonyl (MMT), methyl tert-butyl ether (MTBE), tert-amyl methyl ether, tert-butyl alcohol and ethanol, etc.

Use of MMT and MTBE often causes secondary contamination to the environment. MTBE is prohibited in some states in US by regulations.

Low carbon alcohols, such as ethanol, propanol and tert-butyl alcohol, or the mixtures thereof have a similar function as MTBE when used as gasoline additive. Moreover, they are advantageous in cost over MTBE, so that they have a high potential in the market as gasoline blender. Adding 10% propyl alcohol into gasoline can upgrade the blended gasoline (i.e., increase the octane rating of gasoline), thus creating a significant economic benefit.

Multi-branched alkanes have a higher octane rating than its isomers straight-chain alkanes, and are of a good combustibility in cylinder, i.e., has a small knocking effect, when used as components of regular gasoline. Since straight-chain alkanes have a low octane rating, in oil refining industry they are converted into aromatics through catalytic reforming process, with which straight-chain alkanes are converted into highly branched alkanes as much as possible.

5. Gasoline, Diesel and Kerosene

Generally, hydrocarbon compounds with a carbon chain length of 5-18 contained in oil are liquid at room temperature. For instance, hydrocarbons from C5H12 to C18H38 are all liquid at room temperature. However, hydrocarbons with a carbon chain length above 19 (C19) are solid at room temperature.

Gasoline is generally hydrocarbon with a carbon chain length of 5-11; kerosene is generally hydrocarbon with a carbon chain length of 12-14 or 12-15; and diesel is generally hydrocarbon with a carbon chain length of 15-18 or 14-18. According to the market demand, real fractions of gasoline, diesel and kerosene can be appropriately extended to one or two carbon atoms in both directions.

Not of all of the above-mentioned various materials originate from crude oil, and a small part thereof can be from coal or plant oil. The main difference among gasoline, diesel and kerosene is the carbon chain length.

6. Creativity of the Present Invention

In previous, the main research work for gasoline concentrates on how to improve the octane rating of gasoline and its spontaneous ignition temperature, so as to meet the requirement of increasing the compression ratio of engine and improve the efficiency of engine. Instead, by lowering the octane rating of gasoline and its spontaneous ignition temperature, gasoline can be compressively ignited. In this case, the compression ratio of engine using this kind of gasoline with a low octane rating can be significantly improved, and thus the thermal conversion efficiency of engine can be significantly increased.

SUMMARY OF THE INVENTION

The present invention provides a new kind of clean, high efficient and environmentally friendly gasoline product. It seems as if the gasoline product is a low rating gasoline with an octane rating lower than 50. However, it is actually a new kind of fuel oil for internal combustion engine, not regular oil in common sense. One of its characteristics is that this new gasoline product with a low octane rating can be used in compression ignition. This compression ignition is a kind of diffusion compression ignition, which is different from the current condition that gasoline can be combusted in the gasoline engine smoothly only when it is ignited by the spark plug, and also different from the combustion control method of Homogeneous Charge Compression Ignition (HCCI). That is, the internal combustion engine using this new kind of gasoline product can adopt the technologies of high compression ratio and high air-fuel ratio, but without electronic ignition system, such as a spark plug, which is necessary for current diesel engine. Another characteristic of the gasoline product is that, this new gasoline product has the same or similar fractions as current gasoline, which is different from diesel products for compression ignition. Although diesel products can be compressively ignited and diesel engine is provided with no electronic ignition system, the fractions of diesel are around C14-C18. However, the new gasoline product of this present invention has fractions similar with regular gasoline, around C6-C11.

The new gasoline product with a low octane rating according to the present invention mainly consists of oil rectified hydrocarbon compounds of C6-C12, and a small amount of compounds of carbon, hydrogen and oxygen and compounds of carbon, hydrogen, oxygen and nitrogen. As shown in Table 1, straight-chain alkanes have a low octane rating and are preferred components for gasoline with a low octane rating, while highly branched alkanes (isomerization alkanes) and aromatics have a high octane rating, and thus should be removed to be greatest extent in gasoline having a low octane rating.

As a further development, the new gasoline product with a low octane rating according to the present invention can be extended to C5-C18 based on the hydrocarbon compounds with a carbon chain length of 6-11, as long as its mixture can meet two prerequisites, i.e., "can be used in compressively ignited" and "can be sufficiently combusted within the engine cylinder".

On the other hand, since the new gasoline product according to the present invention has a low octane rating and a low antiknock property, it cannot be directly used in regular gasoline engine.

The new gasoline product with a low octane rating is advantageous in cleanness, efficiency and environmental friendliness. Specifically, (1) High efficient: Since the gasoline with a low octane rating can be used in compression ignition, the internal combustion engine using this gasoline can adopt a high compression ratio and a high air-fuel ratio, and the compression ratio thereof can be up to 14-22. Therefore, thermal efficiency of the internal combustion engine using the new gasoline product is higher than that of regular gasoline engine, and thus has an excellent fuel economy.

(2) Clean: Since the new gasoline product with a low octane rating has a low octane rating e.g., 50, 40, 30 or even negative, the content of aromatics such as xylene, ethylbenzene, toluene, methyl-ethyl benzene and other benzene derivatives with a high octane rating is very low, or even zero. And there is no need to add antiknock additives such as MTBE or MMT for increasing the octane rating of gasoline.

(3) Environmentally friendly: Compared with straight-chain alkanes and highly branched alkanes, exhaust gas from the combustion of aromatics and antiknock additives, such as MTBE, contains tiny amount of nitrogen oxide or compound of carbon, nitrogen and oxygen, which are harmful to the environment and people, and polycyclic aromatic hydrocarbons. Moreover, to increase octane rating, current gasoline products have to be produced through a complex process comprising many steps, and consumption in both energy and material per unit of gasoline product is higher than the gasoline with a low octane rating. Therefore, the new gasoline product with a low octane rating according to the present invention becomes more environmentally friendly.

The new gasoline product according to the present invention can be obtained from appropriately lowering the octane rating of straight-run gasoline in a scope of fractions for regular gasoline.

This kind of new gasoline product has a low requirement on octane rating. Therefore, with respect to different seasons, the component of the gasoline having a low octane rating can be increased to C5 in the season with a low temperature, or increased to C12-C18 in the season with a high temperature.

Gasoline having a low octane rating can be mixed with diesel oil in a ratio selected from a wide scope, in order to improve the performance of diesel oil. For example, to improve atomization performance and complete combustion performance of diesel oil, the mixing ratio can be e.g. 0-50% or 50-100%, and different blended fuel rating can be set according to different mixing ratio. This can improve the liquidity and freezing resistant of diesel oil.

Octane rating can not only used as quality standard for the gasoline product having a low octane rating, but also as identification marker for different products, such as gasoline 40#, 30#, or 50#.

A small amount of ethanol or dimethyl ether can be added into the gasoline having a low octane rating, so as to form blended fuel.

Relative claims are as follows:

1. A clean, high efficient and environmentally friendly gasoline product, which mainly originates from crude oil, is a kind of gasoline having a low octane rating, has a low spontaneous ignition temperature corresponding to that of diesel oil, can be compressively ignited in an internal combustion engine and sufficiently combusted within cylinder of the engine, wherein the compression ratio of the internal combustion engine using said gasoline having a low octane rating is generally 16-19, and can be extended to 14-22;

the main fractions of said gasoline having a low octane rating is C6-C11 alkanes and a small amount of olefins, wherein the higher the content of straight-chain alkanes, the lower the octane rating of gasoline is;

the fractions of said gasoline can be extended to C5-C18 based on C6-C11, so as to form C5-C11 or C6-C18 or C5-C18, wherein the contents of components with various carbon chain lengths (including straight-chain alkanes and its isomer, and a small amount of olefins) is different from each other, the particular contents thereof can be optionally combined according to the requirements of market and users, but said gasoline should meet the prerequisite of being compressively ignited.

2. The gasoline product according to claim 1, wherein, wherein it is used in special-designed and special-produced internal combustion engine, which has a compression ratio of 16-19 (similar to diesel engine);

said internal combustion engine is provided with a lubrication system, a fuel oil storage and a delivery system (similar to gasoline engine) which are necessary for light fuel oil, and also has a pressurized injecting system (pressurized fuel injection pump and pressurized fuel nozzle) for injecting said gasoline into the pressurized cylinder in combustion;

or, said internal combustion engine has a compression ratio of 8-16, such as an internal combustion engine with a supercharging device;

or, said internal combustion engine has a compression ratio of 19-22.

3. The gasoline product according to claim 1, wherein a small amount of fuel ethanol or dimethylether can be added into said gasoline having a low octane rating in order to form blended fuel, which can also meet the prerequisites of being compressively ignited and sufficiently combusted.

4. The gasoline product according to claim 1, wherein said gasoline having a low octane rating can be added into diesel oil as adjuvants for improving atomization performances and complete combustion performance of diesel oil.

SPECIFIC EMBODIMENTS OF THE INVENTION

Embodiment 1

N-heptane, n-hexane and gasoline 93# are mixed together with a ratio of 1:1:1. When each of the three components occupies one-third of the entire volume respectively (they have equal volume before being mixed), the octane rating of the mixed fuel is approximately 39.3 (corresponding to gasoline 39#). The mixed fuel can be compressively ignited by an engine with a compression ratio of 17.6 under normal temperature and pressure.

Embodiment 2

Raffinate oil after aromatic hydrocarbon extraction (a reformate with aromatic hydrocarbon removed therefrom, the main components of the raffinate oil after aromatic hydrocarbon extraction consisting of C6-C11 alkanes) has an octane rating of about 58.7. The oil can be compressively ignited by a 295T internal combustion engine with a compression ratio of 17 under normal temperature and pressure.

Embodiment 3

C5 fraction (hereinafter referred to as "gasoline fraction") is added into the fractions of gasoline having a low octane rating, and the mixed oil has an octane rating of 40. In this case, it can be compressively ignited by an engine with a compression ratio of 12 under the pressurized air with 2 $kg/cm^2$.

Embodiment 4

Kerosene fraction is added into the fractions of gasoline having a low octane rating, and the mixed oil has an octane rating of 30. In this case, it can be compressively ignited by an internal combustion engine with a compression ratio of 17 under normal temperature and pressure.

Embodiment 5

Diesel fraction (30%) is added into the fractions of gasoline having a low octane rating (70%), and the mixed oil has an octane rating of 30. In this case, it can be compressively ignited by a 493Q internal combustion engine with a compression ratio of 18 under normal temperature and pressure.

Embodiment 6

Kerosene fraction (10%) and diesel fraction (50%) are added into the fractions of gasoline having a low octane rating (40%), and the mixed oil has an octane rating of 40. In this case, it can be compressively ignited by an internal combustion engine with the compression ratio of 17 under normal temperature and pressure.

Diffusion compression ignition internal combustion engine having a pressurized gasoline injection system (pressurized fuel injection pump and pressurized fuel nozzle) is especially suitable of extensive use of the new gasoline product having a low octane rating.

The invention claimed is:

1. A gasoline product, comprising, main components of a mixture of hydrocarbons of C6, C7, C8, C9, C10, and C11;

wherein the gasoline product is ignitable by compression at a compression ratio from 8 to 22 in an internal combustion engine;

wherein the content of said mixture of hydrocarbons is more than 50% by weight;

wherein the components include straight-chain alkanes and their isomers and olefins;

wherein the gasoline product has an octane number of 0-58.7; and wherein said gasoline product is used in internal combustion engine by diffusion compression ignition.

2. The gasoline product of claim 1, wherein the mixture of hydrocarbons further includes C5.

3. The gasoline product of claim 1, wherein the mixture of hydrocarbons further includes C12.

4. The gasoline product of claim 1, wherein the mixture of hydrocarbons further includes C5 and C12.

5. The gasoline product of claim 1, which further comprises ethanol, dimethyl ether or a combination thereof.

6. The gasoline product of claim 1, wherein the gasoline product has an octane number of 0-50.

7. The gasoline product of claim 1, wherein the internal combustion engine is a naturally aspirated engine or a forced induction engine.

8. The gasoline product of claim 1, wherein the gasoline product is ignitable by compression at a compression ratio from 8 to 16.

9. The gasoline product of claim 1, which further comprises kerosene.

10. The gasoline product of claim 1, which further comprises diesel.

11. The gasoline product of claim 1, which further comprises kerosene and diesel.

* * * * *